US010381722B2

(12) United States Patent
Mei et al.

(10) Patent No.: US 10,381,722 B2
(45) Date of Patent: Aug. 13, 2019

(54) TUNED GROUNDING ARM FOR NEAR FIELD RADIO COEXISTENCE

(71) Applicant: Google LLC, Mountain View, CA (US)

(72) Inventors: Vincent Mei, Sunnyvale, CA (US); Raemond Bergstrom-Wood, San Francisco, CA (US)

(73) Assignee: Google LLC, Mountain View, CA (US)

( * ) Notice: Subject to any disclaimer, the term of this patent is extended or adjusted under 35 U.S.C. 154(b) by 508 days.

(21) Appl. No.: 15/139,950

(22) Filed: Apr. 27, 2016

(65) Prior Publication Data

US 2017/0317413 A1 Nov. 2, 2017

(51) Int. Cl.

| | |
|---|---|
| ***H01Q 1/52*** | (2006.01) |
| ***H01Q 1/38*** | (2006.01) |
| ***H01Q 1/48*** | (2006.01) |
| ***H01Q 9/42*** | (2006.01) |

(52) U.S. Cl.

CPC ..... *H01Q 1/526* (2013.01); *H01Q 1/38* (2013.01); *H01Q 1/48* (2013.01); *H01Q 1/52* (2013.01); *H01Q 9/42* (2013.01)

(58) Field of Classification Search

CPC ..... H01Q 1/526; H01Q 1/38; H01Q 9/42; H01Q 1/52; H01Q 1/48

See application file for complete search history.

(56) References Cited

U.S. PATENT DOCUMENTS

| | | | | |
|---|---|---|---|---|
| 2002/0175866 | A1* | 11/2002 | Gram | H01Q 1/243 343/702 |
| 2011/0012794 | A1* | 1/2011 | Schlub | H01Q 1/243 343/702 |
| 2016/0020527 | A1* | 1/2016 | Koga | H01Q 9/16 343/727 |

* cited by examiner

*Primary Examiner* — Graham P Smith
*Assistant Examiner* — Jae K Kim
(74) *Attorney, Agent, or Firm* — Kilpatrick Townsend & Stockton LLP

(57) ABSTRACT

Various arrangements for protecting a low-power sensor from electromagnetic interference are presented. A device may have an antenna that is used to transmit a radio signal and have an on-board low-power sensor. A tuned grounding arm may be capacitively coupled with a ground plane of the antenna. The tuned grounding arm can provide a lower energy return path to a feed point of the antenna than through circuitry of the low-power sensor, thus decreasing near-field interference on the low-power sensor.

20 Claims, 10 Drawing Sheets

TUNED GROUNDING ARM FOR NEAR FIELD RADIO COEXISTENCE

BACKGROUND

As electronic devices are built smaller, components that have historically been separated by a significant distance are now being placed in closer proximity. An antenna being used to transmit a wireless signal may cause interference with one or more other components, especially if these one or more other components are located in close proximity to the antenna.

SUMMARY

Various arrangements are presented for protecting a sensor from electromagnetic interference. In some embodiments, a system is presented. The system may include a housing. The system may include an antenna housed within the housing and attached to a first printed circuit board. The system may include antenna feed circuitry that causes the antenna to transmit a signal. The system may include an antenna ground plane that is approximately parallel to the antenna, connected with a ground that is connected with the antenna feed circuitry, attached to the first printed circuit board, and located within the housing. The system may include a sensor that is coupled with a second printed circuit board distinct from the first printed circuit board, the sensor being located within the housing. The system may include a grounding arm that is capacitively coupled with the antenna ground plane, the grounding arm providing a lower energy path to a feed point of the antenna than through circuitry of the sensor.

Embodiments of such a system may include one or more of the following features: The antenna ground plane may be metallic shielding used to shield one or more components mounted on the first printed circuit board. The system may include an adhesive used to adhere a portion of the grounding arm to the antenna ground plane, the adhesive being nonconductive, and may function as a dielectric between the grounding arm and the antenna ground plane. The grounding arm may be an extension of the second printed circuit board, the grounding arm being flexed in one or more locations along the grounding arm. The grounding arm may be flexed, causing an acute angle to be formed between the antenna ground plane and a portion of the grounding arm. The sensor may be a passive infrared (PIR) sensor. A length of the grounding arm may be determined based on a frequency at which the antenna is configured to transmit radio waves. The grounding arm may induce less than a 0.5 dB loss of gain on the antenna.

In some embodiments, a device for protecting a sensor from electromagnetic interference is presented. The device may include a grounding arm that is capacitively coupled with an antenna ground plane of an antenna that radiates a wireless signal, the grounding arm providing a lower energy path to a feed point of the antenna than through circuitry of the sensor, wherein the sensor, the grounding arm, and the antenna are housed within a housing.

Embodiments of such a device may further include one or more of the following features: The device may include a flexible printed circuit board, wherein the grounding arm is mounted on the flexible printed circuit board and the grounding arm is capacitively coupled with the antenna ground plane of the antenna through a dielectric comprising a non-conductive adhesive. The sensor may be a passive infrared (PIR) sensor and the antenna is a printed meander monopole antenna. An acute angle may be formed between a first portion of the grounding arm and a second portion of the grounding arm. The first portion of the grounding arm may be substantially parallel to a first plane of the antenna ground plane and the second portion of the grounding arm is substantially parallel to a printed circuit board on which the sensor is mounted. The grounding arm may cause less than a 0.5 dB loss of gain. A length of the grounding arm may be a wavelength of the wireless signal radiated by the antenna divided by 20. The grounding arm may be offset from a direct path between the antenna and the sensor. A distance between the antenna and the sensor may be less than two wavelengths of a frequency at which the antenna is being used to transmit. A width of the grounding arm may be between 1 and 5 millimeters.

In some embodiments, a method for protecting the sensor from electromagnetic interference is presented. The method may include mounting an antenna, antenna ground plane, and sensor on one or more printed circuit boards to be incorporated as part of a smart sensor device. The method may include mounting a tuned grounding arm within the smart sensor device such that the tuned grounding arm provides a lower energy return path to a feed point of the antenna than through the sensor. The method may include flexing the tuned grounding arm such that a portion of the tuned grounding arm is parallel to the antenna ground plane. The method may include coupling the tuned grounding arm to the antenna ground plane such that the tuned grounding arm is capacitively coupled with the antenna ground plane.

BRIEF DESCRIPTION OF THE DRAWINGS

A further understanding of the nature and advantages of various embodiments may be realized by reference to the following figures. In the appended figures, similar components or features may have the same reference label.

DETAILED DESCRIPTION

When an antenna to be used to transmit radio waves is placed in proximity to a sensor, the transmitting antenna may cause interference with the sensor's readings. Particularly, low-power analog sensors, such as passive infrared (PIR) sensors, may be affected by the antenna's transmissions. An induced voltage on the order of nanovolts in the circuitry of the analog sensor can be substantial enough to affect sensor measurements. For example, if a PIR sensor is being used to detect the presence of a person, such a voltage induced by interference can be sufficient enough to cause a false positive of a person being identified as present.

Near field currents of wireless transmissions tend to follow the lowest energy (lowest impedance) path to the feed point of the transmitting antenna. Therefore, if a path to the antenna's feed point provides a lower energy path than nearby circuitry of a sensor, this path can help decrease the amount of interference to which the sensor is subjected. More specifically, an arm that is tuned the frequency or frequencies at which the antenna is used to transmit may substantially decrease the amount of interference present at the sensor. Further, because the arm provides a lower energy path to the antenna's feed point than the sensor, the arm can remain effective when not directly in the path between the sensor and the antenna.

Possible examples of devices which may benefit from having a transmitting antenna in close proximity to a PIR sensor or other form of low-power analog or digital sensor which may be present on smart home automation devices. Smart home automation devices can be used to monitor conditions within a home or other form of structure and wirelessly communicate with one or more other devices, such as a remote computer server. Due to their use in homes and aesthetics being important, it may be desirable to keep the form factor size of such devices small thus necessitating a need for mounting the antenna and low-power analog sensor in close proximity. As a few examples, a home security system, a smoke detector and/or carbon monoxide hazard detector, and a thermostat may use a tuned grounding arm system as detailed herein to allow for a transmitting antenna to be placed in close proximity to a PIR sensor or other form of low-power analog sensor located within the hazard detector and/or thermostat.

Figure 1:
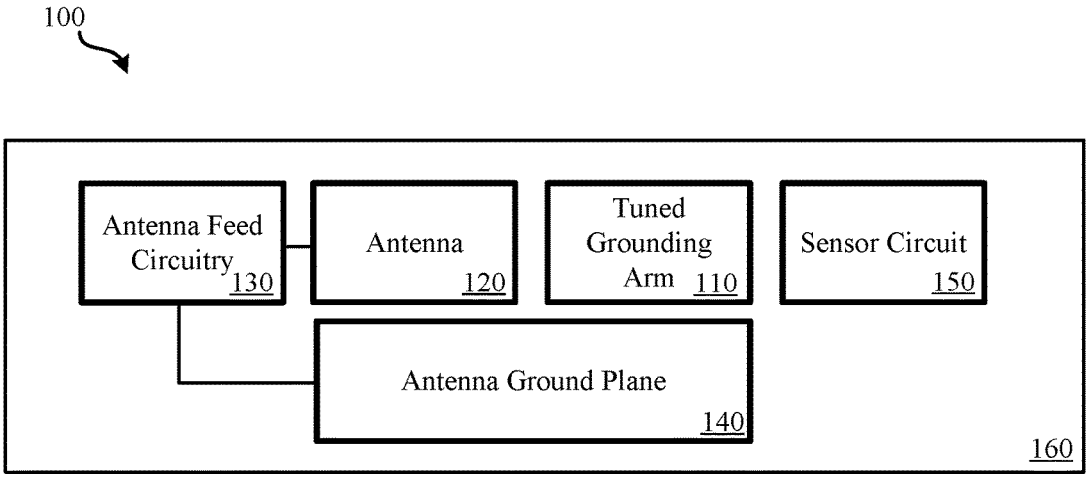
FIG. 1 illustrates a block diagram of an embodiment of a tuned grounding arm system.

FIG. 1 illustrates a block diagram of an embodiment of a tuned grounding arm system 100. Tuned grounding arm system 100 can include: tuned grounding arm 110, antenna 120, antenna feed circuitry 130, antenna ground plane 140, sensor circuit 150 which includes an sensor and associated circuitry, and housing 160. Housing 160 may house each of the other components and may be physically connected with at least some of the components, such as the PCBs, to secure such components in a fixed location within housing 160.

Tuned grounding arm 110 is a conductive material that is tuned, based on its shape (e.g., number of bends, angle of bends), dimensions (e.g., height, length, and width), and location, to provide a lower energy path for near field interference from antenna 120 to the antenna feed point of antenna feed circuitry 130 than through sensor circuit 150. By a lower energy path being present through tuned grounding arm 110 than through sensor circuit 150, the amount of interference caused by electromagnetic emissions from antenna 120 on sensor circuit 150 is decreased. In many embodiments, a lower energy or lower impedance path translates to being a shorter physical path along a ground return path.

Antenna 120 may represent various types of antennas, such as a bended monopole or meander monopole antenna. Other possible types of antenna 120 include an inverted f-type, meander/f-type, and dipole antenna. Antenna 120 may be printed as part of a printed circuit board (PCB). Antenna 120 may have the ability to produce interference when antenna 120: begins transmission of a wireless signal, during transmission of a wireless signal, and/or upon ceasing transmission of a wireless signal. Antenna 120 may be tuned to transmit (and, possibly receive) wireless RF signals at a particular frequency, multiple frequencies, and/or one or more frequency ranges. For example, antenna 120 may be tuned to transmit and/or receive RF communication in the ISM (industrial, scientific, and medical) radio bands, which, depending on the jurisdiction, can range from about 6.7 MHz to about 246 GHz. More specifically, antenna 120 may be used to transmit and/or receive on 2.4 and 5 GHz frequency bands (e.g., for use of the IEEE 802.11 communication protocol), the 868-868.6, 902-928, and/or 2400-2483.5 MHz bands (e.g., for use of the IEEE 802.15.4 communication protocol), and/or the 2402-2480 and/or 2400-2483.5 MHz (e.g., for use as Bluetooth-based communication, which can be referred to as the IEEE 802.15.1 communication protocol).

Antenna 120 receives an electrical signal for transmission from antenna feed circuitry 130. Antenna feed circuitry 130 may also be electrically connected with antenna ground plane 140. Antenna ground plane 140 can serve as an electrically conductive surface that reflects a wireless signal transmitted by antenna 120. In some embodiments, antenna ground plane 140 may be a piece of conductor dedicated to serving as an antenna ground plane, such as a layer on a PCB, or may be a metallic device used for multiple purposes, such as metallic shielding of a component, which could serve as shielding for the component and also as antenna ground plane 140. A transmitter of antenna feed circuitry 130 can have its ground electrically connected with antenna ground plane 140. Antenna 120 may be positioned such that it is at least approximately in a plane parallel to antenna ground plane 140. Antenna feed circuitry 130 may be mounted on a PCB that is physically connected with housing 160.

Tuned grounding arm 110 may be capacitively electrically coupled with antenna ground plane 140 (but may not be directly electrical connected). Tuned grounding arm 110 may be electrically connected with a same ground as sensor circuit 150, which, in turn, can be electrically connected with antenna ground plane 140, and a ground of antenna feed circuitry 130. In some embodiments, sensor circuit 150 and/or tuned grounding arm 110 is located on a separate PCB from antenna 120, antenna ground plane 140 and antenna feed circuitry 130. In some embodiments, sensor circuit 150 and tuned grounding arm 110 are located on separate PCBs, which are each connected with antenna ground plane 140. In some embodiments, the PCB of tuned grounding arm 110 is physically arranged at an angle to antenna ground plane 140 and the PCB on which antenna 120 and antenna feed circuitry 130 are located. In some embodiments, sensor circuit is located on a separate PCB from antenna ground plane 140 and tuned grounding arm 110 is attached with or incorporated as part of a third, flexible PCB. Tuned grounding arm 110 may be incorporated as part of the PCB on which sensor circuit 150 is located. This PCB may be a flexible PCB which can be bent in one or more locations to adjust characteristics and the location of tuned grounding arm 110. For instance, tuned grounding arm 110 may be bent such that a portion of tuned grounding arm 110 is parallel to antenna ground plane 140 and capacitively coupled with antenna ground plane 140 through a dielectric, which may be a non-conductive adhesive. This non-conductive adhesive may serve as a dielectric and to hold tuned grounding arm 110 in place upon antenna ground plane 140.

Sensor circuit 150 can represent various types of digital or analog sensors. For instance, sensor circuit 150 may be an analog PIR sensor and its associated circuitry (e.g., traces to output measurements). A low-power sensor typically relies on a small amount of power to operate and makes sensitive measurements that are susceptible to small amounts of interference. For instance, if a voltage on an order of magnitude of nanovolts is induced in sensor circuit 150, a false positive or other error may result.

Figure 2:
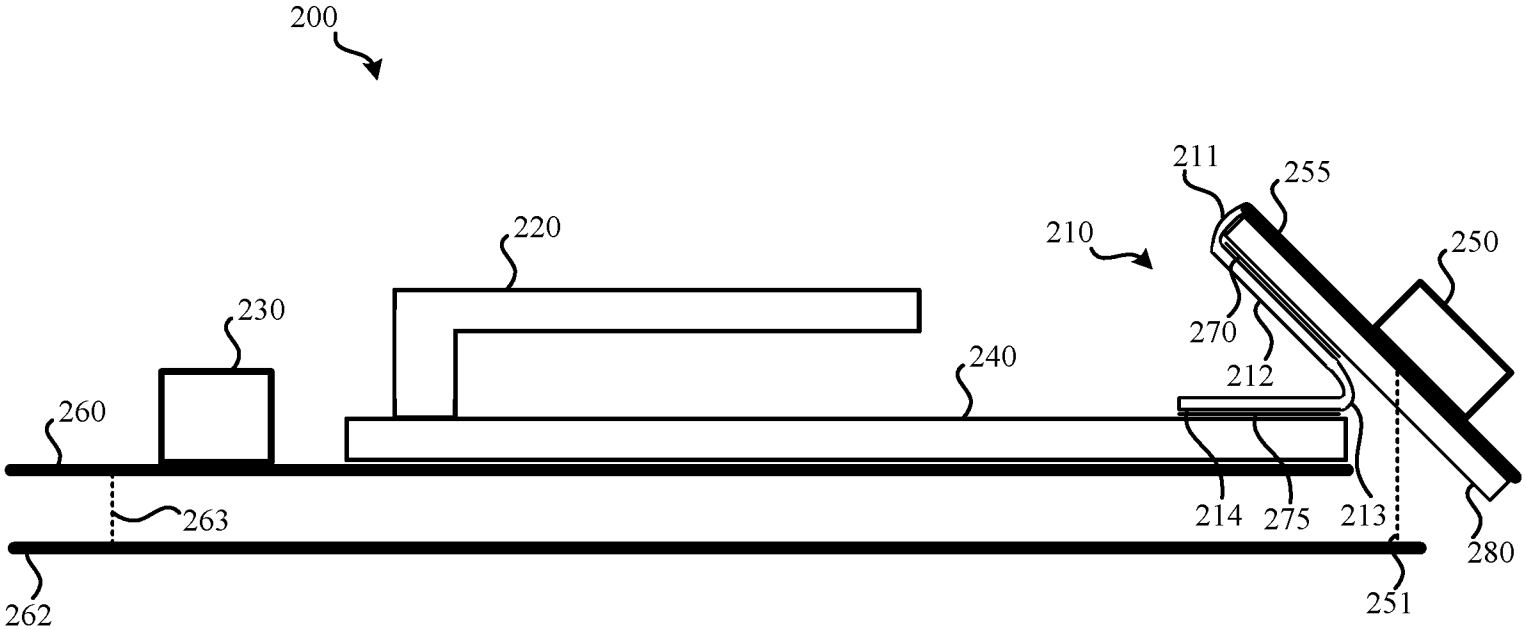
FIG. 2 illustrates an embodiment of a tuned grounding arm system.

FIG. 2 illustrates an embodiment of a tuned grounding arm system 200. Tuned grounding arm system 200 can represent a possible embodiment of tuned grounding arm system 100. Tuned grounding arm system 200 may include: tuned grounding arm 210, antenna 220, antenna feed circuitry 230, antenna ground plane 240, PIR sensor 250, printed circuit boards 255, 260, and 262, and adhesives 270 and 275. It should be understood that antenna 120 may represent antenna 220; antenna feed circuitry 130 can represent antenna feed circuitry 230; tuned grounding arm 110 can represent tuned grounding arm 210; antenna ground plane 140 can represent antenna ground plane 240; and sensor circuit 150 can represent PIR sensor 250. Tuned grounding arm system 200 may be located within a housing with which it is physically coupled, such as housing 160 of FIG. 1 (not illustrated in FIG. 2).

Antenna 220 may be electrically connected with antenna feed circuitry 230 via a trace on PCB 260. Attached with PCB 260 may be antenna ground plane 240. In the illustrated embodiment of tuned grounding arm system 200, antenna ground plane 240 is a magnetic shield that houses one or more components located under antenna ground plane 240 and above PCB 260. Antenna 220 may be a monopole antenna, such as a meandering monopole antenna that is approximately in a parallel plane to a plane of antenna ground plane 240.

PIR sensor 250 may be mounted to PCB 262, which is distinct from PCB 260 and PCB 255. PIR sensor 250 may be mounted to PCB 262, which may be parallel with PCB 260, via leads of PIR sensor 250 which can be mounted at an angle (e.g., via through-holes) on PCB 262. A ground plane of PCB 255 may be connected with a ground plane of PCB 262. The ground of PCB 262 may be connected with a ground plane of PCB 260, which is connected with antenna ground plane 240. The ground of PCB 255 may not have a direct electrical connection with the ground plane of 260; rather, the ground plane of PCB 255 is connected with the ground plane of PCB 262, which is in turn connected with the ground plane of PCB 260. PIR sensor 250 may be connected with only the ground of PCB 262. The ground connection between PIR sensor 250 and the ground plane of PCB 262 is represented by dotted line 251; the ground connection between PCB 262 and PCB 260 is represented by dotted line 263.

PCB 260 and PCB 262 can be rigid or semi-rigid PCBs, while PCB 255 may be a rigid, semi-rigid, or flexible PCB. Further, PCB 255 may be arranged at an angle to PCB 260. As illustrated in tuned grounding arm system 200, PCB 255 is arranged at approximately a 45° angle from parallel with PCB 260. It should be understood that the 45° angle is exemplary. In other embodiments, PCB 255 may be arranged at any angle with respect to PCB 260.

Tuned grounding arm 210 may represent a portion of PCB 255 on which a trace has been printed and is flexible and is flexed into a position as illustrated in FIG. 2. Tuned grounding arm 210 may include: bend 211, portion 212, bend 213, and portion 214. Tuned grounding arm 210 may be flexed such that portion 212 is substantially parallel to PCB 255 and portion 214 is substantially parallel to PCB 260 and antenna ground plane 240. Bend 211 represents a portion of tuned grounding arm 210 that is flexed approximately 180° such that portion 212 is parallel to PCB 255. Bend 213 represents a portion of tuned grounding arm 210 that is flexed approximately 45° to permit portion 214 to be parallel with antenna ground plane 240. Adhesive 275 may adhere portion 214 of tuned grounding arm 210 to antenna ground plane 240; and serve as a nonconductive dielectric between portion 214 and antenna ground plane 240. Adhesive 270 may adhere portion 212 of tuned grounding arm 210 with structure 280. Structure 280 may represent a rigid material to which PCB 255 and adhesive 270 are attached. Structure 280 may be part of or attached with a housing in which system 200 is located, such as housing 160 as presented in FIG. 1.

In order to maintain tuned grounding arm 210 in the flexed position and to capacitively couple tuned grounding arm 210 with antenna ground plane 240, nonconductive adhesive may be used to adhere portion 214 to antenna ground plane 240. By adhering these portions of the tuned grounding arm to structure 280 and antenna ground plane 240, bends 211 and 213 of tuned grounding arm 210 are maintained in flexed positions.

Tuned grounding arm 210 can provide a lower energy return path for near field RF interference to the feed point of antenna feed circuitry 230 than through PIR sensor 250 or associated circuitry. As such, the amount of interference caused at PIR sensor 250 is decreased as compared to an embodiment in which tuned grounding arm 210 is not present. While tuned grounding arm 210 provides a lower energy return path (lower impedance return path) to the antenna's feed point, tuned grounding arm 210 may result in a 0.5 dB loss in gain of the antenna. In other embodiments, the amount of gain lost due to the presence of tuned grounding arm 210 may be greater or smaller. For example, the loss in gain may range between 0.2 dB and 4 dB.

While in tuned grounding arm system 200, tuned grounding arm 210 is a flexed portion of PCB 255 in other embodiments, tuned grounding arm 210 may be a rigid or semi-rigid conductive material (e.g., metal) that can be electrically connected with a ground plane of PCB 255. In such embodiments adhesive 275 and adhesive 270 may not be necessary. Rather than using adhesive 275, another nonconductive material may be used between portion 214 of tuned grounding arm 210 and antenna ground plane 240 to serve as the dielectric. Further, in some embodiments, portion 212 may not be parallel with PCB 255. Rather, portion 212 may be arranged such that it is perpendicular to antenna ground plane 240 or positioned at an angle between PCB 255 and antenna ground plane 240. Further, in some embodiments, antenna feed circuitry 230 may not be located on PCB 260, but maybe located in some other location such as on another PCB.

Figure 3:
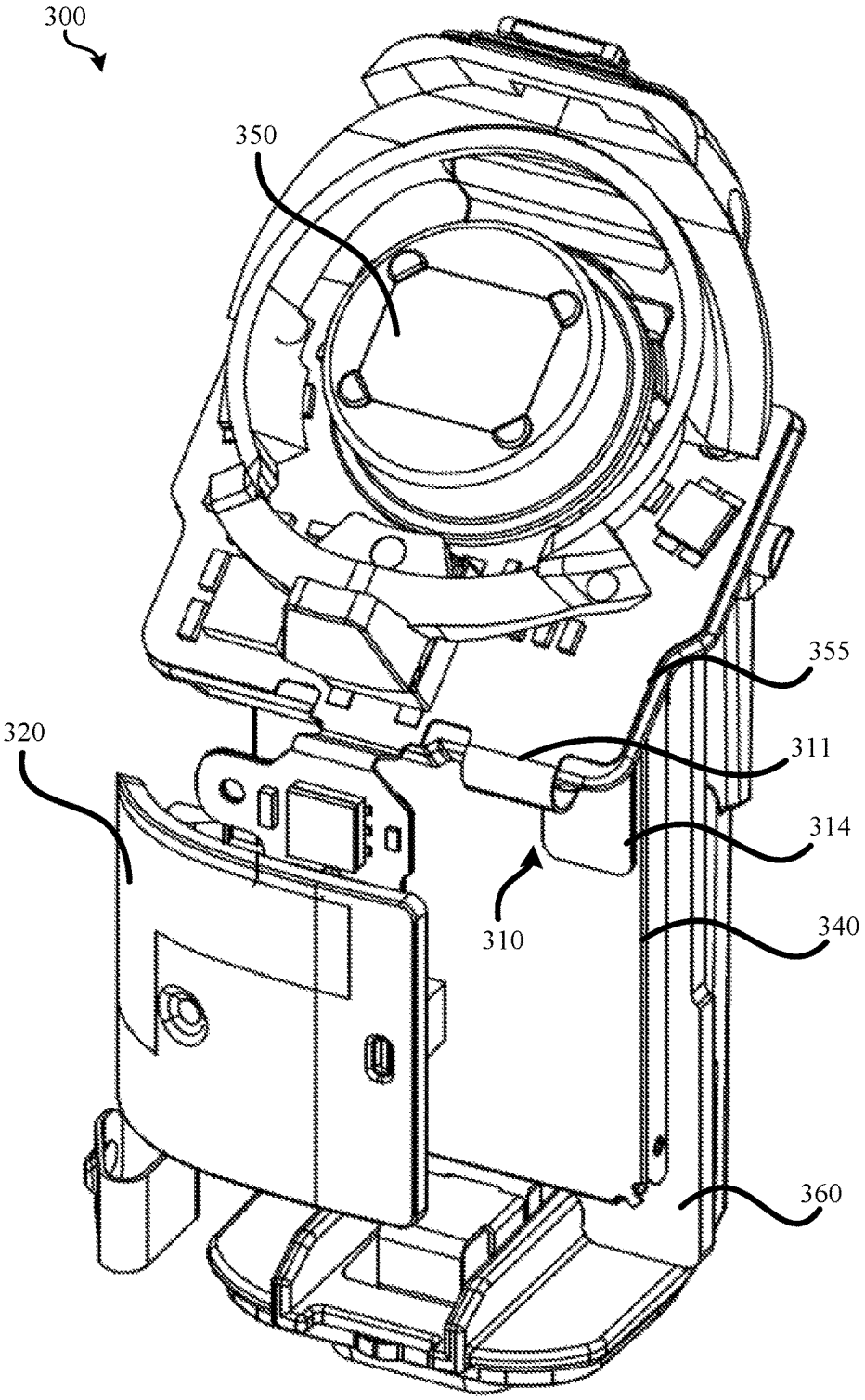
FIG. 3 illustrates an angled view of a tuned grounding arm incorporated as part of an assembly having an antenna mounted in close proximity to a low-power sensor.
Figure 4:
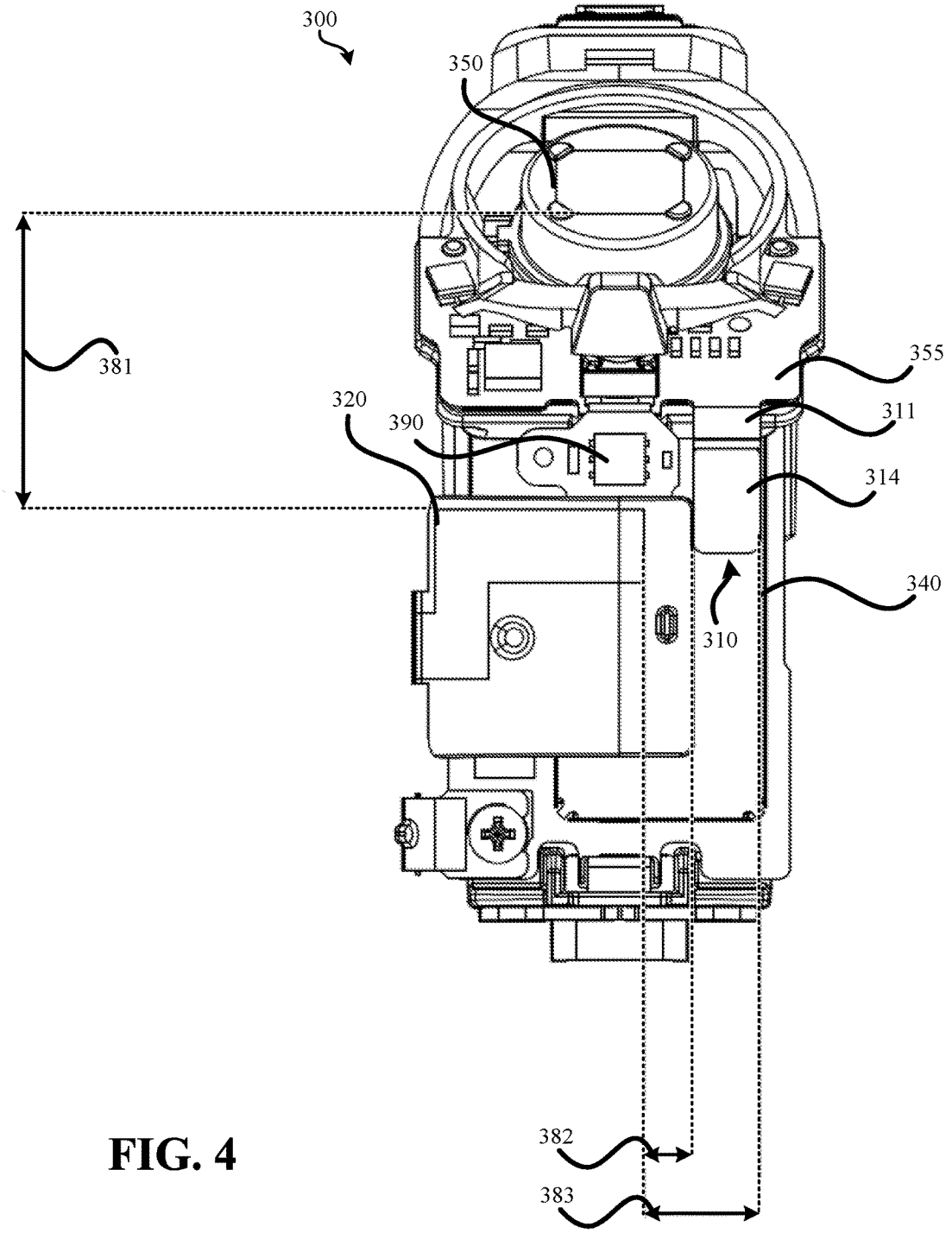
FIG. 4 illustrates a front view of a tuned grounding arm incorporated as part of an assembly having an antenna mounted in close proximity to a low-power sensor.
Figure 5:
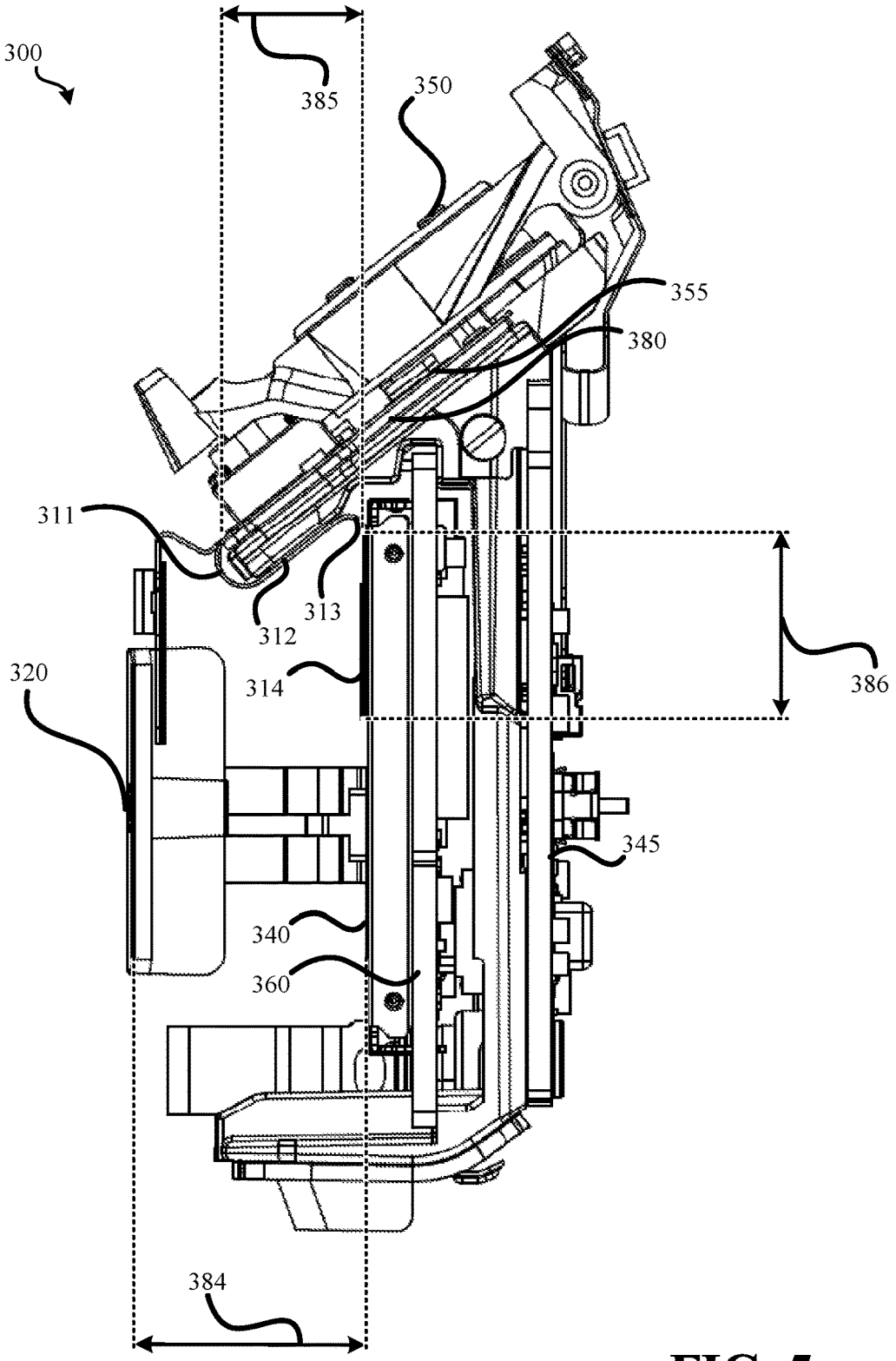
FIG. 5 illustrates a side view of a tuned grounding arm incorporated as part of an assembly having an antenna mounted in close proximity to a low-power sensor.

FIGS. 3-5 show a more detailed assembly that includes a tuned grounding arm. The assembly of FIGS. 3-5 can be represented by the embodiments detailed in relation to FIGS. 1 and 2. For example, the assembly of FIGS. 3-5 may be incorporated as part of a smart home security system, a smart smoke and/or carbon monoxide detector, a smart thermostat, or some other sensor device that uses an analog sensor and wirelessly transmits data. FIG. 3 illustrates an angled view of a tuned grounding arm incorporated as part of assembly 300 having an antenna mounted in close proximity to an analog sensor.

In FIG. 3, antenna 320 is part of a PCB that is raised from antenna ground plane 340. Antenna 320 is a meandering monopole antenna, which can vary in other embodiments of assembly 300. Antenna ground plane 340 also functions as metallic shielding for one or more components that are located between antenna ground plane 340 and PCB 360.

In the illustrated embodiment, tuned grounding arm 310 is a bent portion of flexible PCB 355. PIR sensor 350 can be mounted to flexible PCB 355 or to a separate PCB board, such as detailed in relation to FIG. 2. PIR sensor 350 and the metallic trace of tuned grounding arm 310 may be electrically connected with the same ground plane of either flexible PCB 355 or the separate PCB board. In some embodiment, a trace of tuned grounding arm 310 is an extension of a ground plane of flexible PCB 355. Bend 311 represents a portion of tuned grounding arm 310 that is flexed during manufacture and maintained in a flexed position by portion 314 of tuned grounding arm 310 being affixed using adhesive to antenna ground plane 340. Rather than a trace forming the conductive portion of tuned grounding arm 310, a metallic or otherwise conductive layer may be affixed to the bent portion of PCB 355 to function as tuned grounding arm 310. Alternatively, tuned grounding arm 310 may be a separate structure from PCB 355 that is coupled with the ground of PCB 355. In such embodiments, a flexible PCB may not be used to form tuned grounding arm 310, but rather a fixed rigid or semi-rigid structure may form tuned grounding arm 310.

FIG. 4 illustrates a front view of a tuned grounding arm incorporated as part of assembly 300 having an antenna mounted in close proximity to a low-power analog sensor. FIG. 4 represents an alternate view of the embodiment of assembly 300 illustrated in FIG. 3. In some embodiments, antenna 320 is located a distance of 12.12 millimeters from PIR sensor 350 (as indicated by distance 381). It should be understood that this distance is merely exemplary and that such a tuned grounding arm design can permit use of PIR sensor 350 with a limited amount of interference being caused by transmissions of antenna 320 (e.g., as detailed in relation to FIG. 9) when there is a smaller or greater distance present between antenna 320 and PIR sensor 350. For example, a tuned grounding arm can be effective when distance 381 is less than two wavelengths (of the frequency at which the antenna is being used to transmit). Distance 381 may be at least five millimeters.

FIG. 4 also illustrates distance 382, which represents a distance between an edge of antenna 320 and tuned grounding arm 310. Distance 382, in some embodiments, is 2.02 mm. It should be understood that this distance is merely exemplary; distance 382 may vary between zero (e.g., no offset from antenna 320) and two wavelengths (of the frequency at which the antenna is being used to transmit). Distance 382 represents a lateral offset from antenna 320 to a proximal edge of tuned grounding arm 310. It should be understood that tuned grounding arm 310 may be located in some embodiments directly between antenna 320 and PIR sensor 350 (or some other type of analog sensor). For instance, in assembly 300, integrated circuit 390 is in a location that prevents tuned grounding arm 310 from being positioned directly between antenna 320 and PIR sensor 350. However, since tuned grounding arm 310 still represents a lower resistance path to a feed point of antenna 320 than through circuitry of PIR sensor 350, the amount of interference caused by transmission by antenna 320 to PIR sensor 350 is reduced. In some embodiments, tuned grounding arm 310 may be located such that it is proximate to the highest current density portion of antenna 320 when antenna 320 is transmitting.

Distance 383 represents a lateral offset from antenna 320 to a distal edge of tuned grounding arm 310. Distance 383 is, in some embodiment, 4.8 mm. Distance 383 can be dependent on distance 382 and the width of tuned grounding arm 310. For example, the width of tuned grounding arm 310 may be 2.78 mm. In other embodiments, the width of tuned grounding arm 310 may be greater or smaller (e.g., between 1 and 5 mm). The width of tuned grounding arm 310 may be based on the frequency or frequencies at which antenna 320 is used to transmit. In some embodiments, the width may be determined according to equation 1. In other embodiments, the width may be varied to be greater or smaller, such as between 1/90 and 1/15 the length of a wavelength.

$$w = \frac{\lambda}{45} \qquad \text{Eq. 1}$$

FIG. 5 illustrates a side view of a tuned grounding arm incorporated as part of assembly 300 having an antenna mounted in close proximity to a sensor. Distance 384 represents a distance that antenna 320 is raised above antenna ground plane 340. In some embodiments, distance 384 is about 7.63 mm. In other embodiments, distance 384 may be larger or smaller; for example, distance 384 may range from 0 to 2 wavelengths. The length of portion 314, indicated by distance 386, which can be attached with antenna ground plane 340 via a nonconductive adhesive, may be about 6.12 mm. This length may vary by embodiment and can be greater or smaller. This length may vary based on the frequency at which antenna 320 transmits. The overall length of tuned grounding arm 310, which includes bend 311, portion 312, bend 313, and portion 314, may be determined based on equation 2 and may be 13.72 mm in some embodiments. In other embodiments, the length may be greater or smaller.

$$l = \frac{\lambda}{20} \qquad \text{Eq. 2}$$

By the width and length of tuned grounding arm 310 being selected based on a frequency or frequencies at which antenna 320 transmits, the grounding arm is "tuned" to reduce interference by creating a lower energy path to the feed point of antenna 320 than through circuitry of PIR sensor 350.

Distance 385 represents the distance from an edge of bend 311 to an edge of bend 313. In the illustrated embodiment, distance 385 is about 4.67 mm. In other embodiments this distance may vary between 1 mm and 10 mm. Distance 385 may be varied to accommodate the location of PCB 355 and antenna ground plane 340.

As can be seen in FIG. 5, flexible PCB 355 is flexed around structure 380, which serves to support flexible PCB 355 and cause flexible PCB 355 to be maintained at an angle of approximately 45 degrees to antenna ground plane 340. FIG. 5 also illustrates PCB 345. PIR sensor 250 may be mounted to PCB 345 via long leads that allow PIR sensor 250 to be mounted at an angle to PCB 345. PCB 355 may be in the proximity of PIR sensor 350 and may at least partially surround PIR sensor 350, but no direct electrical connection between PCB 255 and PIR sensor 350 may be present; rather, both PCB 255 and PIR sensor 350 may be electrically connected with a ground plane of PCB 345, which is connected with a ground plane of PCB 360. The ground plane of PCB 360 being connected with antenna ground plane 340.

Figure 6:
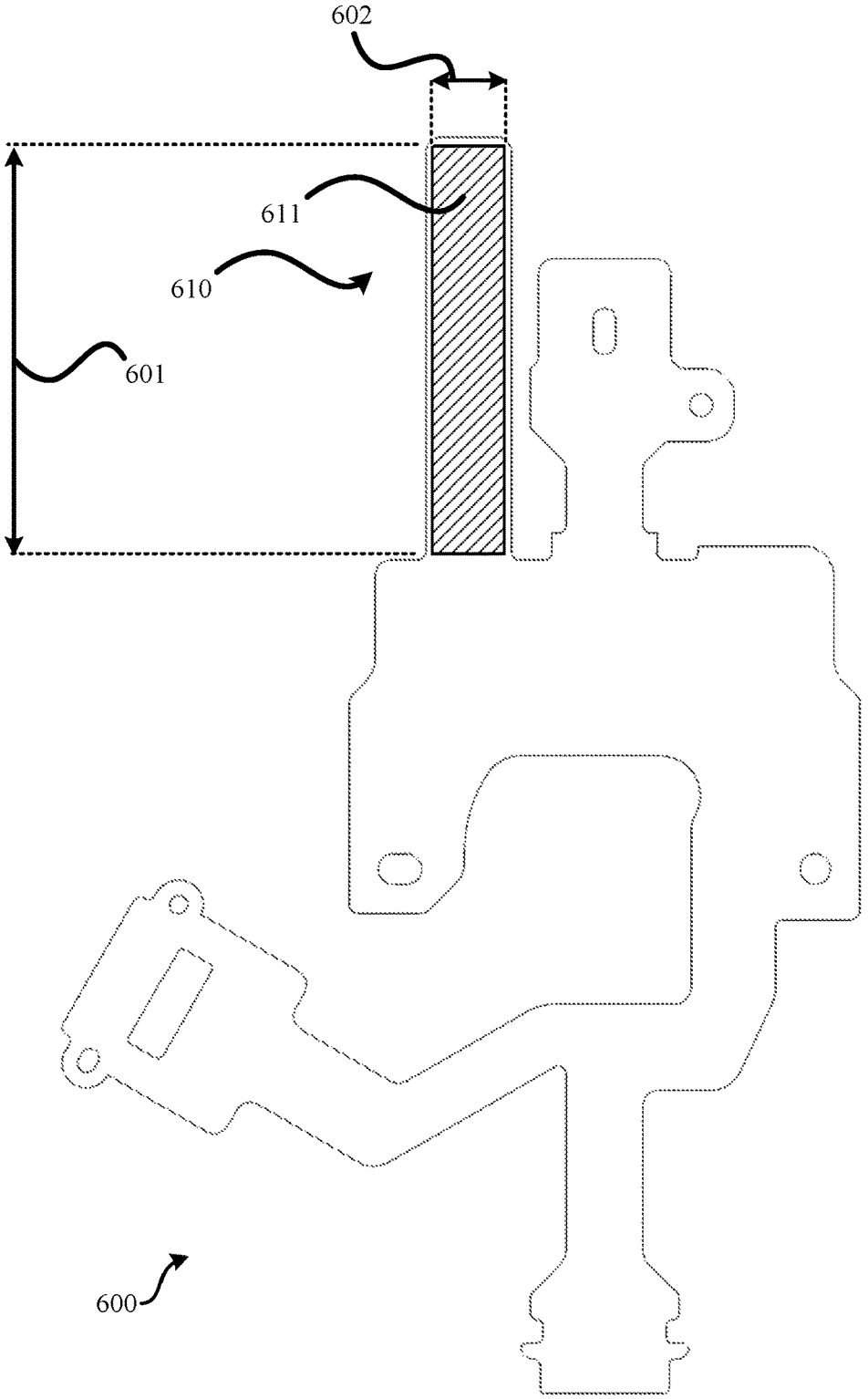
FIG. 6 illustrates an embodiment of a tuned grounding arm incorporated as part of a flexible printed circuit board.

FIG. 6 illustrates an embodiment of a tuned grounding arm incorporated as part of a flexible printed circuit board 600. Flexible PCB 600 can represent PCB 355 and PCB 255 in an unflexed state. That is, flexible PCB 600 may be initially manufactured in a form similar to FIG. 6, then bent into a configuration similar to FIGS. 2-5. Various portions of flexible printed circuit board 600 may be configured to be bent in different directions than tuned grounding arm 610. As illustrated, tuned grounding arm 610 has not been bent into the configurations as illustrated in FIGS. 2-5.

The portion of flexible PCB 600 to be used as tuned grounding arm 610 may have a wide trace printed on it, as illustrated by trace 611, to serve as a conductor. Alternatively, a conductive material may be otherwise attached to the portion of flexible PCB 600 to be used as tuned grounding arm 610. The effective length 601 (as detailed in relation to equation 2) and width 602 of tuned grounding arm 610 may be defined as the portion that is conductive; such as trace 611. Trace 611, or another conductive material attached with tuned grounding arm 610, may be connected with a ground plane of flexible PCB 600 or may be an extension of a ground plane of flexible PCB 600. The sensor, such as the PIR sensor, may not be directly electrically and/or physically connected with flexible PCB 600.

Tuned grounding arm 610 and, if it is distinct, a ground plane of PCB, may be electrically connected with a ground that is electrically connected with the ground of the antenna feed circuitry, such as antenna feed circuitry 230. Therefore, while tuned grounding arm 610 may be capacitively coupled with the antenna ground plane when installed as part of a tuned grounding arm system or assembly, tuned grounding arm 610, a ground plane of flexible PCB 600, a ground of antenna feed circuitry, and the antenna ground plane may be electrically connected (e.g., via one or more wires or traces).

It should be understood that the shape of flexible PCB 600 is merely exemplary. Specifically, the outline of flexible PCB 600 is specific to a particular implementation of flexible PCB 600 that can be used in conjunction with a smart device, such as a smart home security system, a smart carbon monoxide and/or smoke detector. Other embodiments of flexible PCB 600 may be shaped substantially differently, but can have a portion similar to tuned grounding arm 610.

Figure 7:
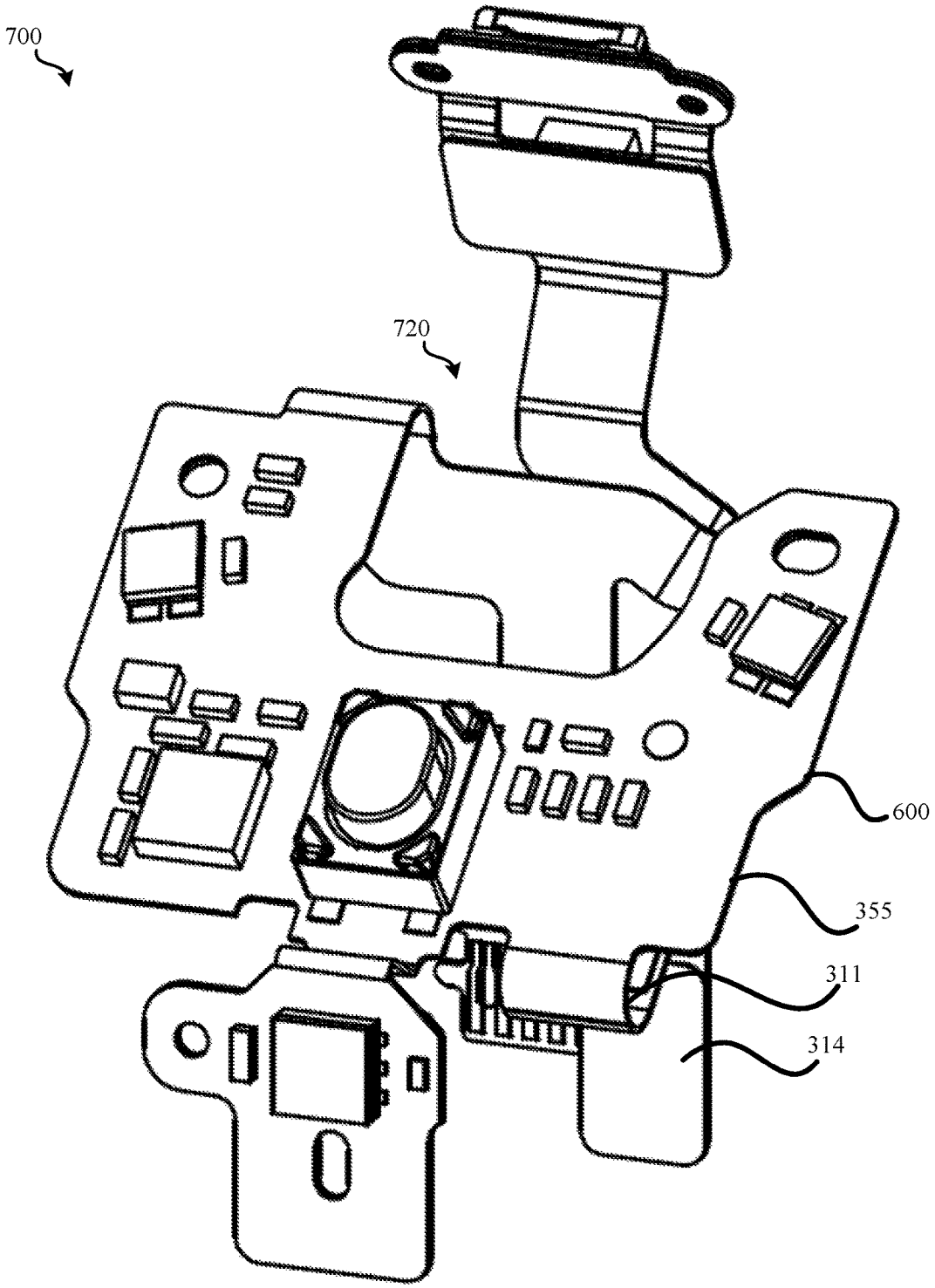
FIG. 7 illustrates an angled view of an embodiment of a tuned grounding arm incorporated as part of a flexible printed circuit board on which components are mounted.
Figure 8A:
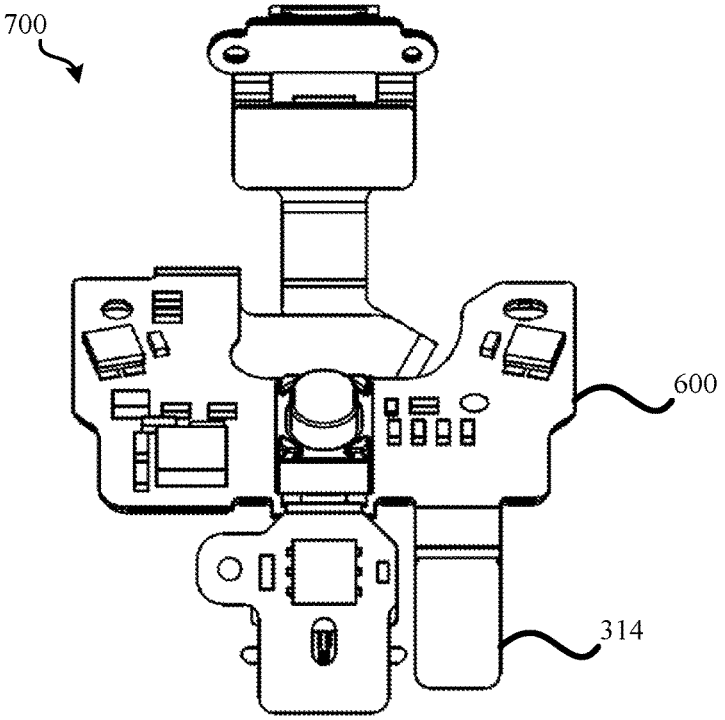
FIG. 8A illustrates a front view of an embodiment of a tuned grounding arm incorporated as part of a flexible printed circuit board on which components are mounted.
Figure 8B:
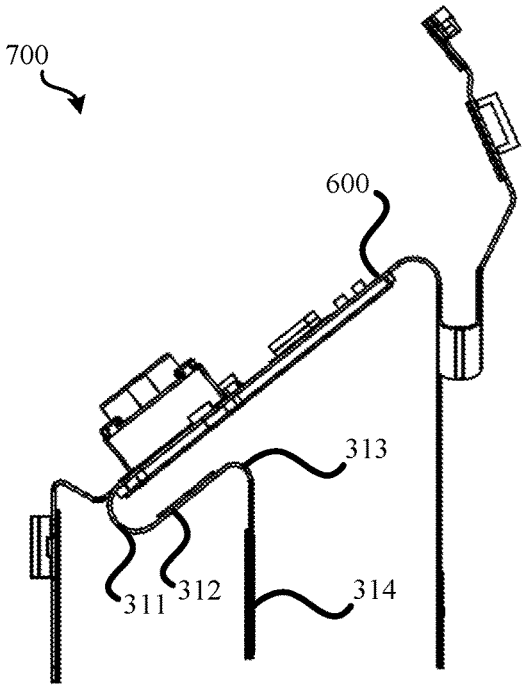
FIG. 8B illustrates a side view of an embodiment of a tuned grounding arm incorporated as part of a flexible printed circuit board on which components are mounted.

FIG. 7 illustrates an angled view of an embodiment of a tuned grounding arm system 700 incorporated as part of a flexible printed circuit board on which components are mounted. Tuned grounding arm system 700 includes flexible PCB 600 of FIG. 6 flexed into a double-bend position, as similarly presented in relation to FIGS. 2-5. Additionally, various components are arranged on flexible PCB 600. A PIR sensor may be attached with a separate PCB such that the PIR sensor will reside in empty region 720 of flexible PCB 600. Empty region 720 may not include a physical or electrical connection between flexible PCB 600 and the PIR sensor. Tuned grounding arm system 700 is further illustrated from additional views in FIGS. 8A and 8B. FIG. 8A illustrates a front view of an embodiment of a tuned grounding arm incorporated as part of a flexible printed circuit board on which components are mounted. FIG. 8B illustrates a side view of an embodiment of a tuned grounding arm incorporated as part of a flexible printed circuit board on which components are mounted.

Figure 9:
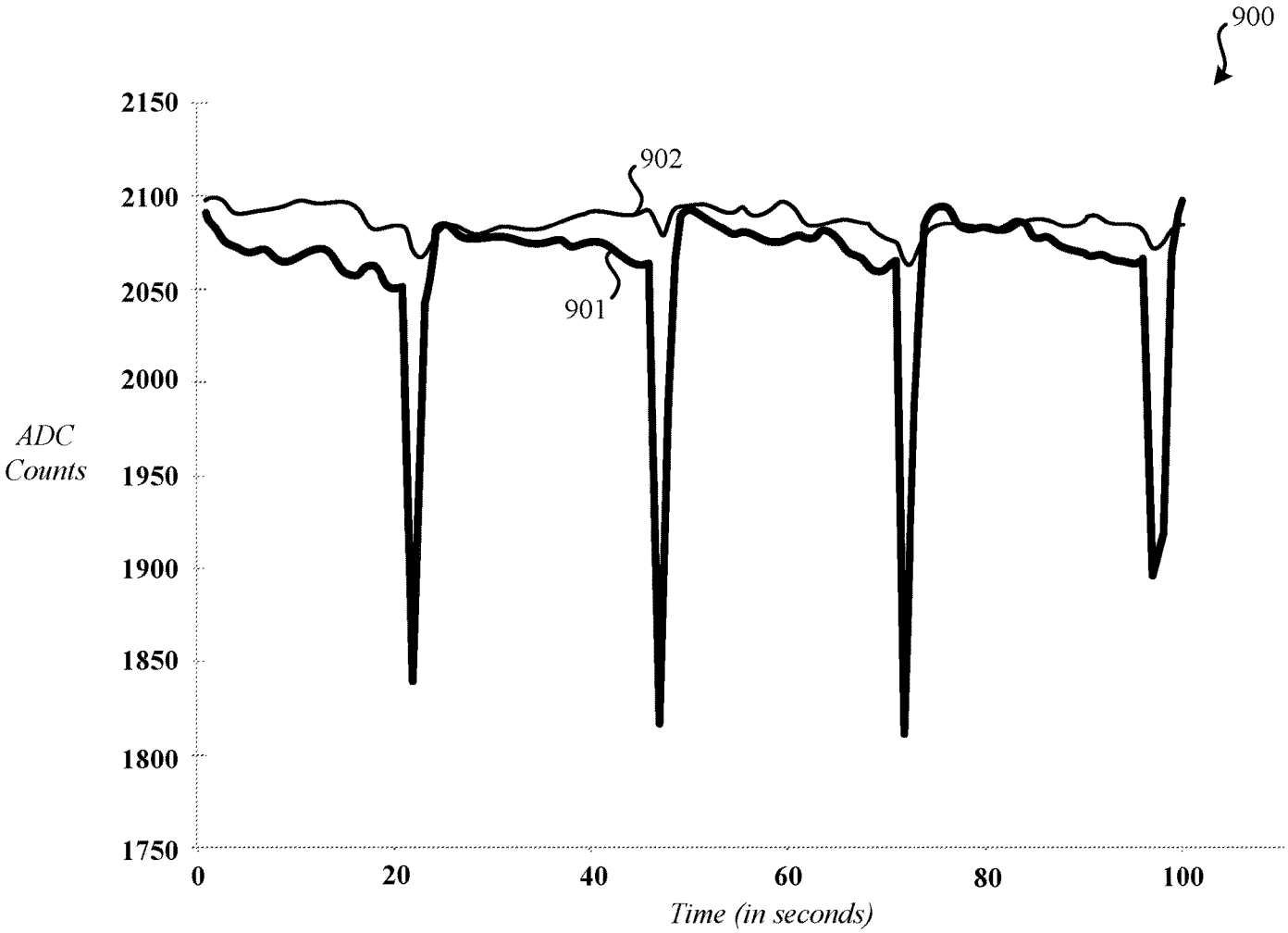
FIG. 9 illustrates a graph comparing interference between a device having a tuned grounding arm and a similar device without a tuned grounding arm.

FIG. 9 illustrates a graph 900 comparing interference between a device having a tuned grounding arm (represented by line 902) and a similar device without a tuned grounding arm (represented by line 901). The ADC (analog to digital converter) count represents the raw converted output from an analog sensor, which in this example is a PIR sensor. In some embodiments, a drop of greater than 70 counts may result in a false positive being registered (e.g., a person being detected as present based on the converted and analyzed PIR sensor output). In graph 900, every 25 seconds, a transmission is performed using the antenna. As can be seen on line 901, this transmission causes the ADC count to drop by approximately 270, which results in false positive detections. However, for line 902, which represents a system that utilizes a tuned grounding arm, such as detailed in relation to FIGS. 1-8B, a drop in ADC count of 20 or less was observed, thus eliminating or at least greatly decreasing the number of false positives.

Figure 10:
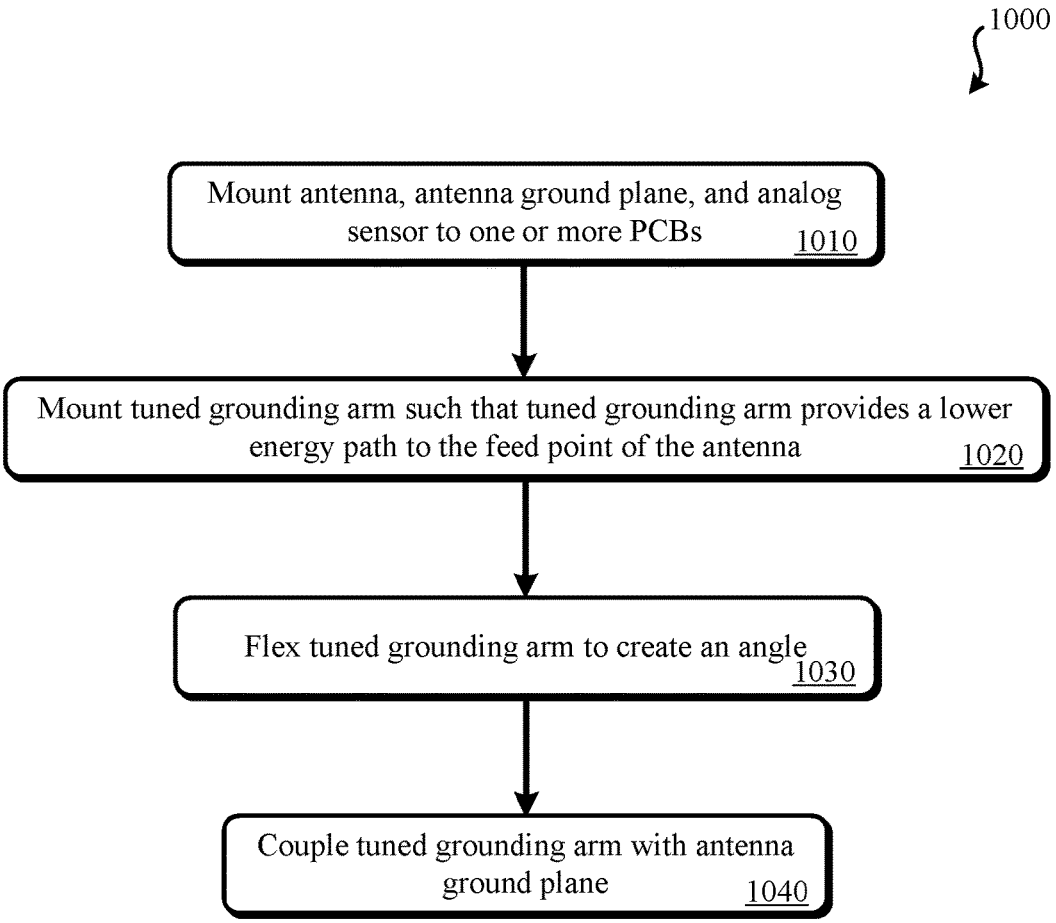
FIG. 10 illustrates an embodiment of a method for using a tuned grounding arm.

FIG. 10 illustrates an embodiment of a method 1000 for using a tuned grounding arm. Method 1000 may be used in the manufacture of a device in which an antenna to be used to transmit is to be placed within a device in close proximity to a sensor, such as a PIR sensor. For example, method 1000 may be used during the manufacture of a small device (e.g., being housed within a device that is equal to or less than 15 cm by 15 cm by 5 cm in outside dimensions) that requires both an analog sensor and to transmit radio waves.

At block 1010, in antenna and a sensor may be mounted on printed circuit boards that are be to installed within a device. The antenna and the sensor may be mounted on the same or separate printed circuit boards. The antenna ground plane may be incorporated as part of the printed circuit board to which the antenna is mounted. Alternatively, the antenna ground plane may be a metallic structure that is mounted to the same printed circuit board as the antenna. In some embodiments, the antenna ground plane may be a metallic shielding that is mounted to house one or more components. At block 1020, a tuned grounding arm may be mounted such that the tuned grounding arm provides a lower energy path to the feed point of the antenna, then through the sensor or the sensor's associated circuitry. The tuned grounding arm may be mounted to or incorporated as part of the printed circuit board to which the sensor is mounted. In other embodiments, the tuned grounding arm may be mounted to or incorporated as part of the printed circuit board to which the antenna or the antenna's feed circuitry is mounted. In some embodiments, the sensor, antenna's feed circuitry, and tuned grounding arm are each coupled with separate PCBs.

At block 1030, the tuned grounding arm, if it is incorporated as part of a flexible printed circuit board, may be flexed to create an angle. By flexing the tuned grounding arm, the amount of space occupied by the tuned grounding arm within the device may be decreased. The tuned grounding arm may be flexed in one or more than one locations, such as to locations as illustrated in FIGS. 2-5 and 7-8B. If the tuned grounding arm is not made from a flexible material, the tuned grounding arm may be constructed such that it is rigid or semi-rigid and includes an angle such that a portion of tuned grounding arm is parallel to the antenna ground plane mounted at block 1010 and a portion of the tuned grounding arm is parallel to the printed circuit board on which the sensor is mounted.

At block 1040, the tuned grounding arm may be coupled with the antenna ground plane. The tuned grounding arm may be coupled with the antenna ground plane via a nonconductive adhesive which serves to both hold the tuned grounding arm in place in its flexed position and also to serve as a dielectric between a portion of the tuned grounding arm and the antenna ground plane.

Following block 1010-1040, when the antenna is used to transmit, especially at the frequencies to which the tuned grounding arm is tuned, the amount of interference caused on the sensor may be decreased as compared to if the tuned grounding arm was not present. As such, it may be possible to have mounted the antenna closer to the sensor than if the tuned grounding arm was not present and still have the sensor function without being affected by an undue amount of interference.

The methods, systems, and devices discussed above are examples. Various configurations may omit, substitute, or add various procedures or components as appropriate. For instance, in alternative configurations, the methods may be performed in an order different from that described, and/or various stages may be added, omitted, and/or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Specific details are given in the description to provide a thorough understanding of example configurations (including implementations). However, configurations may be practiced without these specific details. For example, well-known circuits, processes, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Also, configurations may be described as a process which is depicted as a flow diagram or block diagram. Although each may describe the operations as a sequential process, many of the operations can be performed in parallel or concurrently. In addition, the order of the operations may be rearranged. A process may have additional steps not included in the figure. Having described several example configurations, various modifications, alternative constructions, and equivalents may be used without departing from the spirit of the disclosure. For example, the above elements may be components of a larger system, wherein other rules may take precedence over or otherwise modify the application of the invention. Also, a number of steps may be undertaken before, during, or after the above elements are considered.

What is claimed is:

1. A system for protecting a sensor from electromagnetic interference, the system comprising:

a housing;

an antenna housed within the housing and attached to a first printed circuit board;

antenna feed circuitry that causes the antenna to transmit a signal;

an antenna ground plane that is approximately parallel to the antenna, connected with a ground that is connected with the antenna feed circuitry, attached to the first printed circuit board, and is located within the housing;

a sensor that is located within the housing; and a grounding arm that is capacitively coupled with the antenna ground plane, the grounding arm providing a lower impedance path to a feed point of the antenna than through circuitry of the sensor, wherein the grounding arm decreases electromagnetic interference caused by the signal being transmitted by the antenna on sensor measurements made by the sensor.

2. The system for protecting the sensor from electromagnetic interference of claim 1, wherein the antenna ground plane is metallic shielding used to shield one or more components mounted on the first printed circuit board.

3. The system for protecting the sensor from electromagnetic interference of claim 1, further comprising an adhesive used to adhere a portion of the grounding arm to the antenna ground plane, the adhesive being nonconductive and functioning as a dielectric between the grounding arm and the antenna ground plane.

4. The system for protecting the sensor from electromagnetic interference of claim 1, wherein the grounding arm is an extension of a second printed circuit board, the grounding arm is flexed in one or more locations along the grounding arm.

5. The system for protecting the sensor from the electromagnetic interference of claim 4, wherein the flexed grounding arm forms an acute angle between the antenna ground plane and a portion of the grounding arm.

6. The system for protecting the sensor from the electromagnetic interference of claim 1, wherein the sensor is a passive infrared (PIR) sensor.

7. The system for protecting the sensor from the electromagnetic interference of claim 1, wherein a length of the grounding arm is determined based on a frequency at which the antenna is configured to transmit radio waves.

8. The system for protecting the sensor from the electromagnetic interference of claim 1, wherein the grounding arm induces less than a 0.5 dB loss of gain on the antenna.

9. A device for protecting a sensor from electromagnetic interference, the device comprising:

a grounding arm that is capacitively coupled with an antenna ground plane of an antenna that radiates a wireless signal, the grounding arm providing a lower impedance path to a feed point of the antenna than through circuitry of a sensor, wherein:

the sensor, the grounding arm, and the antenna are housed within a housing; and the grounding arm decreases electromagnetic interference caused by signals transmitted by the antenna on sensor measurements made by the sensor.

10. The device for protecting the sensor from the electromagnetic interference of claim 9, further comprising:

a flexible printed circuit board, wherein the grounding arm is mounted on the flexible printed circuit board and the grounding arm is capacitively coupled with the antenna ground plane of the antenna through a dielectric comprising a non-conductive adhesive.

11. The device for protecting the sensor from the electromagnetic interference of claim 10, wherein the sensor is mounted on the flexible printed circuit board.

12. The device for protecting the sensor from the electromagnetic interference of claim 9, wherein the sensor is a passive infrared (PIR) sensor and the antenna is a printed meander monopole antenna.

13. The device for protecting the sensor from the electromagnetic interference of claim 9, wherein an acute angle is formed between a first portion of the grounding arm and a second portion of the grounding arm.

14. The device for protecting the sensor from the electromagnetic interference of claim 13, wherein the first portion of the grounding arm is substantially parallel to a first plane of the antenna ground plane and the second portion of the grounding arm is substantially parallel to a printed circuit board on which the sensor is mounted.

15. The device for protecting the sensor from the electromagnetic interference of claim 9, wherein the grounding arm causes less than a 0.5 dB loss of gain.

16. The device for protecting the sensor from the electromagnetic interference of claim 9, wherein a length of the grounding arm is a wavelength of the wireless signal radiated by the antenna divided by 20.

17. The device for protecting the sensor from the electromagnetic interference of claim 9, wherein the grounding arm is offset from a direct path between the antenna and the sensor.

18. The device for protecting the sensor from the electromagnetic interference of claim 9, wherein a distance between the antenna and the sensor is less than two wavelengths of a frequency at which the antenna is being used to transmit.

19. The device for protecting the sensor from the electromagnetic interference of claim 9, wherein a width of the grounding arm is between 1 and 5 millimeters.

20. A method for protecting a sensor from electromagnetic interference, the method comprising:

mounting an antenna, an antenna ground plane, and a sensor on one or more printed circuit boards to be incorporated as part of a smart sensor device;

mounting a tuned grounding arm within the smart sensor device such that the tuned grounding arm provides a lower energy return path to a feed point of the antenna than through circuitry of the sensor;

flexing the tuned grounding arm such that a portion of the tuned grounding arm is parallel to the antenna ground plane; and coupling the tuned grounding arm to the antenna ground plane such that the tuned grounding arm is capacitively coupled with the antenna ground plane, wherein the tuned grounding arm decreases electromagnetic interference caused by signals transmitted by the antenna on sensor measurements made by the sensor.

* * * * *